United States Patent [19]

Candor

[11] 4,309,685

[45] Jan. 5, 1982

[54] THERMALLY ACTUATABLE ELECTRICAL SWITCH CONSTRUCTION AND METHOD OF MAKING THE SAME

[75] Inventor: James T. Candor, Washington Township, Montgomery County, Ohio

[73] Assignee: Emerson Electric Company, St. Louis, Mo.

[21] Appl. No.: 87,047

[22] Filed: Oct. 22, 1979

[51] Int. Cl.[3] ..... H01H 37/76

[52] U.S. Cl. ..... 337/408; 337/409

[58] Field of Search ..... 337/407, 408, 409

[56] References Cited

U.S. PATENT DOCUMENTS

| | | | |
|---|---|---|---|
| 3,820,050 | 6/1974 | Tyler et al. | 337/408 |
| 3,821,685 | 6/1974 | Kimball et al. | 337/409 |
| 3,827,014 | 7/1974 | Wehl | 337/407 |
| 3,930,215 | 12/1975 | Senor | 337/409 X |
| 3,944,960 | 3/1976 | Audette | 337/409 |
| 4,109,229 | 8/1978 | Plasko | 337/408 |
| 4,167,724 | 9/1979 | McCaughna | 337/408 |
| 4,184,139 | 1/1980 | Hara | 337/408 |
| 4,276,531 | 6/1981 | Davis | 337/407 |
| 4,281,309 | 7/1981 | Olson | 337/409 |

FOREIGN PATENT DOCUMENTS

| | | | |
|---|---|---|---|
| 2853321 | 6/1979 | Fed. Rep. of Germany | 337/407 |
| 1164589 | 9/1969 | United Kingdom | 337/409 |

*Primary Examiner*—George Harris

*Attorney, Agent, or Firm*—Candor, Candor & Tassone

[57] ABSTRACT

A thermally actuatable electrical switch construction having a resilient contact member normally biased into electrical contact with a stationary contact member while a temperature sensitive member of the construction is in a solid condition and normally springing out of contact with the stationary contact member by the natural bias of the resilient contact member when the temperature sensitive member is rendered non-solid by sensing a temperature above a predetermined temperature, a guide member being carried by the construction and being operatively associated with the resilient contact member to provide a guide for the resilient contact member that will substantially insure that the resilient contact member will move and be maintained out of contact with the stationary contact member after the temperature sensitive member has been rendered non-solid.

24 Claims, 8 Drawing Figures

THERMALLY ACTUATABLE ELECTRICAL SWITCH CONSTRUCTION AND METHOD OF MAKING THE SAME

BACKGROUND OF THE INVENTION

1. Field of the Invention

This invention relates to an improved thermally actuatable electrical switch construction and to a method of making the same.

2. Prior Art Statement

It is known to provide a thermally actuatable electrical switch construction having a resilient contact member normally biased into electrical contact with a stationary contact member while a temperature sensitive member of the construction is in a solid condition and normally springing out of contact with the stationary contact member by the natural bias of the resilient contact member when the temperature sensitive member is rendered non-solid by sensing a temperature above a predetermined temperature.

For example, see the following item:

(1) U.S. Pat. No. 3,827,014—Wehl

It also presently appears that the following three items are effective references against this application and each illustrates and describes that the resilient contact member can comprise a hollow body carried by the insulated terminal and be radially expanded outwardly into electrical contact with the casing side wall by the solid temperature sensitive member and spring radially inwardly out of contact with that casing side wall when the temperature sensitive member is rendered non-solid.

(2) U.S. Pat. No. 4,167,724—McCaughna (3) German Pat. No. 2,837,827—Hara.

(4) U.S. Pat. No. 4,184,139—Hara.

It is also known to deform a resilient contact member out of contact with the casing side wall when the temperature sensitive member is rendered non-solid, the means for deforming the contact member comprising a cup-shaped insulating member containing the temperature sensitive member in the cup thereof and telescoping over the resilient contact member by a spring force acting on the closed end of the cup-shaped member when the temperature sensitive member is rendered non-solid.

For example, see the following two items:

(5) U.S. Pat. No. 3,930,215—Senor (6) U.S. Pat. No. 3,944,960—Audette et al

SUMMARY OF THE INVENTION

It is also known to have the deformable contact member be initially moved into contact with the casing interior side wall as the contact member is being initially inserted into the conductive casing during initial assembly of the thermally actuatable switch construction, the contact member thereafter being deformed away from contact with the casing side wall solely by a spring loaded deforming member when the temperature sensitive member is rendered non-solid.

For example, see the following two items:

(7) U.S. Pat. No. 4,109,229—Plasko (8) German Pat. No. 2.911,950—Olson et al

It is a feature of this invention to provide an improved thermally actuatable electrical switch construction that has a resilient contact member normally biased into electrical contact with a stationary contact member while a temperature sensitive member of the construction is in a solid condition and normally springing out of contact with the stationary contact member by the natural bias of the resilient contact member when the temperature sensitive member is rendered non-solid by sensing a temperature above a predetermined temperature.

In particular, it is believed according to the teachings of this invention that guide means can be provided in such a thermally actuatable switch construction to always insure that the resilient contact member will move and be maintained out of the contact with the stationary contact member after the temperature sensitive member has been rendered non-solid.

For example, in one embodiment of this invention such a guide means comprises a spring loaded cup-shaped member which will telescope over the resilient contact member after the temperature sensitive member is rendered non-solid so that if the natural bias of the resilient contact member does not pull the resilient contact means out of contact from the stationary contact member, the cup-shaped guide member will wedge between the resilient contact member and the stationary contact member to provide and maintain an insulated barrier therebetween.

Accordingly, one embodiment of this invention provides a thermally actuatable electrical switch construction having a resilient contact member normally biased into electrical contact with a stationary contact member while a temperature sensitive member of the construction is in a solid condition and normally springing out of contact with the stationary contact member by the natural bias of the resilient contact member when the temperature sensitive member is rendered non-solid by sensing a temperature above a predetermined temperature, the construction having a guide means operatively associated with the resilient contact member to provide a guide for the resilient contact member that will substantially insure that the resilient contact member will move and be maintained out of contact with the stationary contact member after the temperature sensitive member has been rendered non-solid.

Thus, it is an object of this invention to provide an improved thermally actuatable electrical switch construction having one or more of the novel features of this invention as set forth above or hereinafter shown or described.

Another object of this invention is to provide a method of making such a thermally actuatable electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
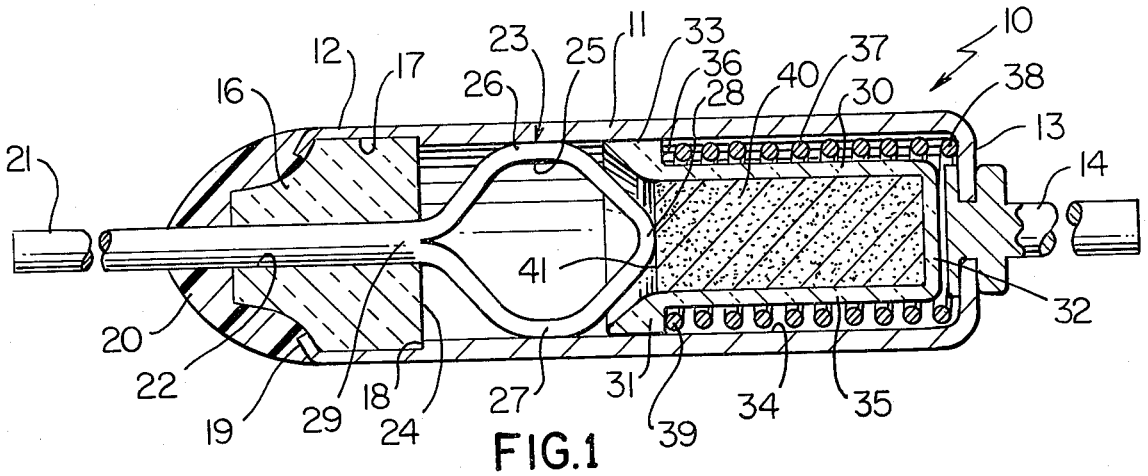
FIG. 1 is a cross-sectional view of one embodiment of the thermally actuatable electrical switch construction of this invention.

While the various features of this invention are hereinafter described and illustrated as being particularly adapted to provide a thermally actuatable electrical switch construction, it is to be understood that the various features of this invention can be utilized singly or in any combination thereof to provide other types of electrical switch constructions as desired.

Therefore, this invention is not to be limited to only the embodiments illustrated in the drawings, because the drawings are merely utilized to illustrate one of the wide variety of uses of this invention.

Referring now to FIG. 1, an improved thermally actuatable electrical switch construction of this invention is generally indicated by the reference numeral 10 and comprises an open ended conductive casing 11 having an opened end 12 and a closed end 13, the closed end 13 of the casing 11 having an external conductive lead or terminal 14 secured thereto in any suitable manner so as to be electrically interconnected to the casing 11.

A sub-assembly of this invention for the thermally actuatable switch construction 10 is generally indicated by the reference numeral 15 in FIG. 3 and comprises an insulating end plug 16 of ceramic material or the like adapted to be received in a counter bore 17 in the open end 12 of the casing 11 in a manner hereinafter described to abut against an internal shoulder 18 thereof whereby the left hand end 19 of the casing 11 can be turned over to secure the end plug 16 within the open end 12 of the casing 11 as illustrated in FIG. 1 and thereby close the open end 12 which is adapted to be further sealed closed by an epoxy resin sealing means 20 in a manner well known in the art.

The end plug 16 of the sub-assembly 15 has an electrical conductive lead or terminal 21 disposed through an opening 22 thereof in a manner to be press-fitted therein or otherwise secured thereto so that the end plug 16 and lead 21 are self-contained and can be inserted in the open end 12 of the casing 11 as a sub-assembly in a manner hereinafter described.

Figure 2:
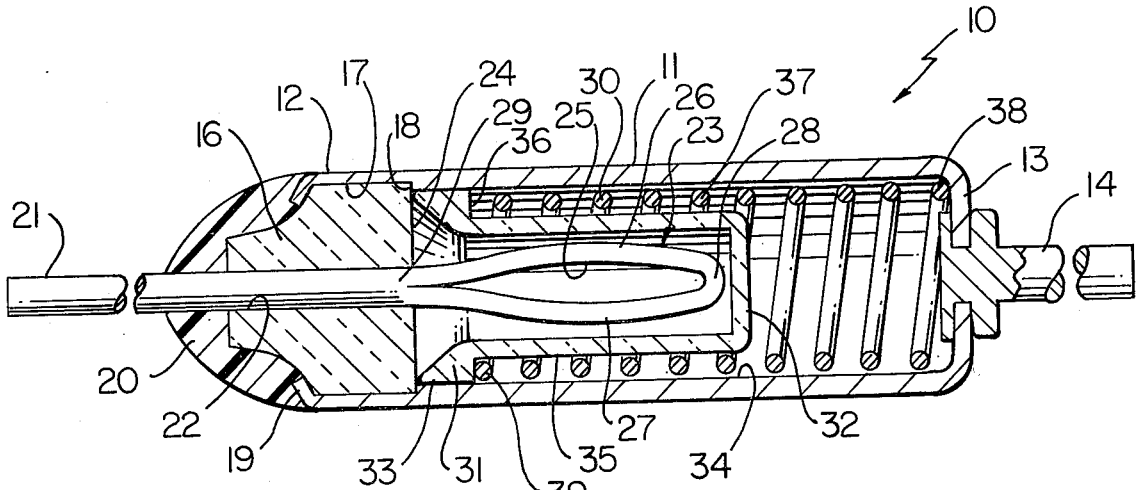
FIG. 2 is a view similar to FIG. 1 and illustrates the switch construction after the same has been thermally actuated.
Figure 3:
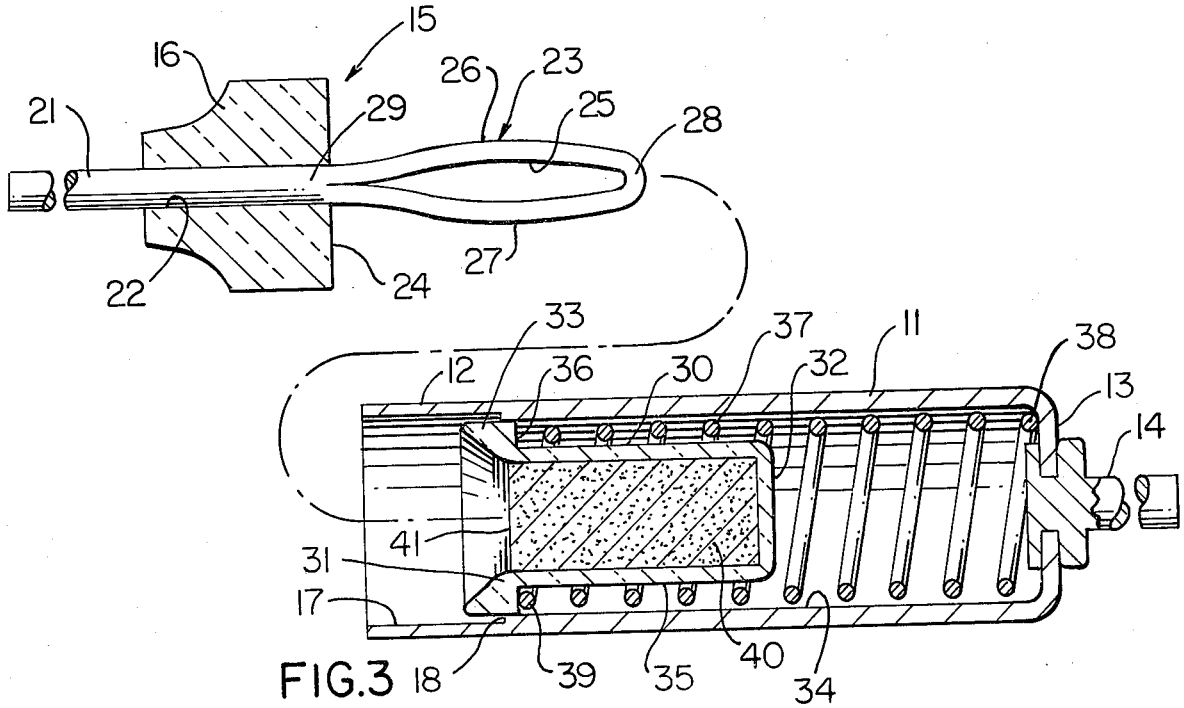
FIG. 3 is an exploded view similar to FIG. 1 and illustrates one of the steps in the method of this invention for making the thermally actuatable electrical switch construction of FIG. 1.

The lead or terminal 21 carries a resilient contact member that is generally indicated by the reference numeral 23 and which projects beyond an end wall 24 of the end plug 16 so as to be received within the casing body 11, the resilient contact member 23 of the embodiment illustrated in FIGS. 1–3 comprising an integral and homogeneous part of the terminal or lead 21 as the same has been split by having a slit or opening 25 formed therethrough to define two opposed parts 26 and 27 integrally and homogeneously interconnected together at the right hand ends thereof by a looped portion 28 and at the left hand end thereof by the solid body portion 29 of the terminal 21.

In this manner, it is believed that by imposing a force against the end 28 of the resilient contact member 23 and in a direction toward the end plug 16 while holding the end plug 16 stationary, the resilient contact member 23 will expand radially outwardly so that the opposed parts 26 and 27 move away from each other and have a normal tendency or bias to move back toward each other when the force against the end 28 of the resilient contact member 23 is released as will be apparent hereinafter.

Thus, it is believed that the resilient contact member 23 will have a natural tendency to assume the condition illustrated in FIGS. 2 and 3 when no force is imposed against the end 28 thereof as will be apparent hereinafter.

Of course, it may be found that it is desirable and/or necessary to perform conventional heat treating operations or the like on the terminal 21 before and/or after it is assembled to the end plug 21 to insure the aforementioned resiliency for the contact member 23 to operate in the manner hereinafter described.

If desired, a suitable arrest member (not shown) could be disposed in the opening or slit 25 of the contact member and be secured to one of the parts 26 and 27 thereof adjacent the end plug 16 so as to hold the parts slightly spread apart adjacent the end plug 16 whereby the terminal or lead 21 can not be pulled out of the opening 22 in the end plug 16 should someone pull outwardly on the terminal or lead 21 after the switch construction has been assembled in a manner hereinafter set forth.

A cup-shaped guide member 30 of this invention is provided for the thermally actuatable switch construction 10 and is formed of any suitable electrically insulating material, such as ceramic material, the cup-shaped guide member having an open end 31 and a closed end 32. The open end 31 has an outwardly directed annular cam like flange 33 which is adapted to loosely slide against the interior cylindrical side wall means 34 of the casing 11 while being disposed relatively close thereto. However, the cylindrical body portion 35 of the cup-shaped member 30 is spaced inwardly from the side wall means 34 of the casing 11 so as to define an annular transverse shoulder 36 with the annular flange 33.

In this manner, a coiled compression spring 37 can be disposed in the casing 11 and have one end 38 bear against the closed end 13 of the casing 11 and the other end 39 thereof be telescoped over the cylindrical body portion 30 of the cup-shaped member 30 and engage against the annular shoulder 36 thereof so as to always tend to urge the cup-shaped guide member 30 toward the end plug 16 for a purpose hereinafter described.

A temperature sensitive member 40, normally provided in solid pellet form and of a type conventional in the art, is adapted to be disposed in the cup-shaped guide member 30 and substantially completely fill the same from the closed end 31 to closely adjacent the annular cam flange 33 and thereby define a flat end surface 41 that is exposed at the open end 31 of the cup-shaped member 30.

The thermally sensitive member 40 is adapted to melt and, thus, be rendered non-solid, when the same is heated to or senses a predetermined temperature in a manner well known in the art for thermally actuatable electrical switch constructions as evidenced by items (1)–(5) set forth in the Prior Art Statement of this application.

From the above, it can be seen that the thermally actuatable electrical switch construction 10 of this invention can be formed from a relatively few parts by the method of this invention in a manner now to be described.

After the sub-assembly 15 of the end plug 16 and terminal 21 has been formed in the manner previously set forth, the compression spring 37 is placed in the casing 11 in the manner illustrated in FIG. 3 and the pellet filled cup-shaped member 30 is inserted therein to engage against the end 39 of the spring 37.

Thereafter, the sub-assembly 15 is inserted into the open end 12 of the casing 11 whereby the end 28 of the resilient contact member 23 engages against the surface 41 of the pellet 40 and begins to move the cup-shaped member 30 to the right in the drawings by compressing the compression spring 37 whereby the force of the compression spring 37 increases. Accordingly, either before or after the cup-shaped member 30 has its closed end 32 bottomed out against the closed end 30 of the casing 11, the inserting force on the sub-assembly 15 and the force in opposition thereto causes the resilient contact member 23 to have the end 28 thereof, in effect, moved toward the end wall 24 of the end plug 16 so that the parts 26 and 27 move radially outwardly so that by the time the end plug 16 is fully received in the counter bore 17 of the casing 11 and is disposed against the shoulder 18 thereof, it is believed that the resilient parts 26 and 27 of the contact member 23 will make positive contact against the inside surface 34 of the casing 11 on opposite sides thereof and will generally assume the shape illustrated in FIG. 1. Thereafter, the end 19 of the casing 11 is turned over the end plug 16 to hold the end plug 16 in its fully assembled relation and the epoxy seal 20 is added to seal the end plug 16 in place to the casing 11 as well as to the lead or terminal 21 projecting from the end plug 16.

Figure 4:
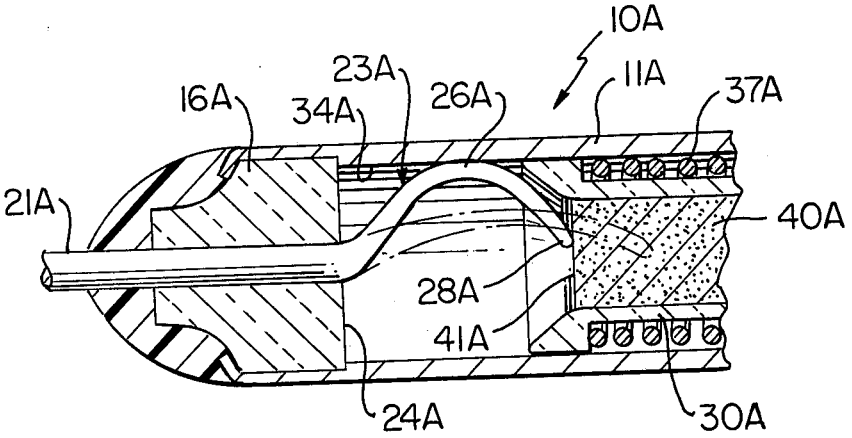
FIG. 4 is a fragmentary view similar to FIG. 1 and illustrates another embodiment of the thermally actuatable switch construction of this invention.

Thus, it can be seen that as long as the pellet 40 remains solid in the condition illustrated in FIG. 1, the resilient contact member 23 remains in contact with the inside surface of FIG. 4 of the casing 11 to complete the electrical circuit between the leads or terminals 21 and 14.

Should the pellet 40 in its solid condition tend to shrink through the shelf or use life thereof, the compression spring 37 still maintains the end 41 thereof against the end 28 of the resilient contact member 23 so that the resilient contact member 23 does not move from the position illustrated in FIG. 1 as the cup-shaped member 30 can move slightly to the left in FIG. 1 without having its cam flange 33 engage against the resilient contact member 23.

Alternately, the cup-shaped member 30 may remain against the end wall 13 of the casing 11 and the contact member 23 may lengthen under its natural resilient force to take up any shrinkage of the pellet 40, the parts 26 and 27 remaining in contact with the casing side wall 34 during such lengthening of the contact member 23 as it can be seen that a considerable length thereof in FIG. 1 are initially in contact with the casing 11 so as to permit some thereof to outwardly lengthen the contact member 23 while leaving still a relatively long length thereof in contact with the wall 34.

However, when the thermally actuatable switch construction 10 has the pellet 0 thereof melt because of the same sensing the afore-mentioned predetermined temperature, no longer is a force applied against the end 28 of the resilient contact member 23 to hold the same in the shape illustrated in FIG. 1 whereby it is believed that the parts 26 and 27 of the resilient contact member 23 will have a natural tendency to spring toward each other away from the casing wall 34 in the manner illustrated in FIG. 2 to disconnect the terminal 21 from the terminal 14. At the same time the force of the compression spring 37 forces the cup-shaped member 30 to the left in FIG. 2 to place the annular cam flange 33 thereof against the end wall 24 of the end plug 16 so that the resilient contact member 23 is completely surrounded by insulating material.

However, it is believed that if one or both of the parts 26 and 27 of the resilient contact member 23 have become stuck to the casing wall 34 for any reason, the action of the cup-shaped member 30 being driven to the left in the drawings by the compression spring 37 after the temperature sensitive member 40 is rendered non-solid, will cause the cam surface 33 to wedge between the parts 26 and 27 and the surface 34 of the casing 11 not only through the cam shape of the flange 33, but also because of the cam shape of the parts 26 and 27 so as to release and move the parts 26 and 27 away from contact with the casing wall 34.

Therefore, it can be seen that the guide member 30 of this invention is believed to substantially always insure that the resilient contact member 23 will move and be maintained out of contact with the stationary contact member 11 after the temperature sensitive member 40 has been rendered non-solid.

However, it can be seen that when the temperature sensitive member 40 is rendered non-solid, it is believed that the natural biasing action of the resilient contact member 23 tends to break the electrical connection between the terminals 21 and 14 by the parts 26 and 27 completely breaking away from the casing 11 and moving toward each other without the need of the guide member 30. Nevertheless, the guide member 30 will insure that the parts 26 and 27 at least break loose from the casing 11 and thereafter be moved toward each other due to the natural bias thereof or by the cup-shaped member 30 being forced over the same by the compression spring 37 whereby the cup-shaped member 30 will completely surround the resilient contact member 23 to make sure that the same will not droop or otherwise thereafter again make contact with the casing 11 while in the actuated condition of FIG. 2.

Accordingly, it can be seen that it is believed that the thermally actuatable electrical switch construction 10 of this invention has an improved feature of the guide means 30 thereof always insuring that the resilient contact member 23 will move and be maintained out of contact with the casing 11 after the temperature sensitive member 40 has been rendered non-solid.

Further, it can be seen that it would appear to be a relatively simple manner to assemble the electrical switch construction 10 of this invention from the sub-assembly 15 and the arrangement of the parts 30 and 37 in the casing 11 as illustrated in FIG. 3.

While the thermally actuatable electrical switch construction 10 of this invention has been illustrated and described as having two parts 26 and 27 for radially being placed into contact with the inside surface 34 of the casing 11, it is to be understood that the resilient contact member 23 could have more than two parts 26 and 27 as desired.

Alternately, it is to be understood that the resilient contact member 23 need only have one part that is moved or radially expanded into contact with the inside surface 34 of the casing 11.

For example, reference is made to FIG. 4 wherein another embodiment of the thermally actuatable electrical switch construction of this invention is generally indicated by the reference numeral 10A and parts thereof similar to the thermally actuatable electrical construction 10 previously described are indicated by like reference numerals followed by the reference letter "A".

As illustrated in FIG. 4, the terminal or lead 21A has the resilient contact means 23A thereof formed by only a single part 26A extending beyond the end wall 24A of the end plug 16A so as to have the end 28A thereof be adapted to bear against the end surface 41A of the temperature sensitive member 40A to be forced into electrical contact with the internal surface 34A of the casing 11A in substantially the manner previously described when the sub-assembly 15A is inserted into the casing 11A.

Thus, it is believed that when the temperature sensitive member 40A is rendered non-solid by sensing a predetermined temperature, the compression spring 37A will move the cup-shaped guide member 30A to the left in FIG. 4 for the reasons previously set forth and the natural bias of the member 26A will move the same inwardly in the manner illustrated by phantom lines in FIG. 4 so as to break the electrical connection between the terminal or lead 21A and the casing 11A for the reasons previously set forth.

While the thermally actuatable electrical switch constructions 10 and 10A have the resilient contact means 23 and 23A thereof integral and homogeneous with the respective terminals or leads 21 and 21A, it can be understood that the resilient contact member could be formed from a part separate from the insulated lead or terminal and be subsequently secured thereto to still function in the manner previously described.

Figure 5:
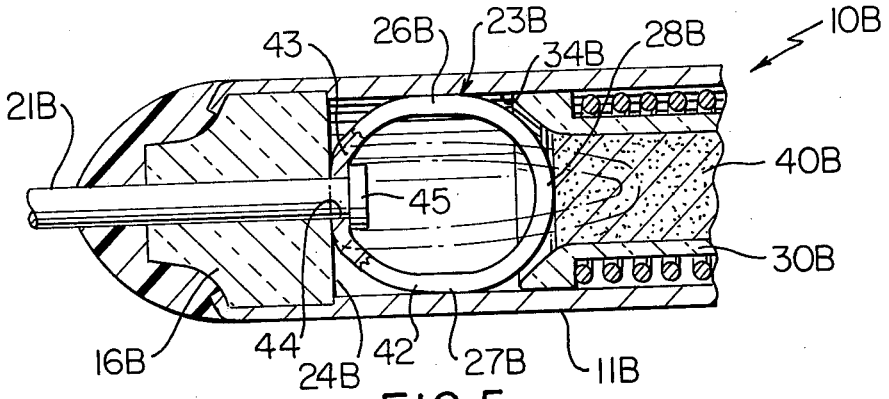
FIG. 5 is a view similar to FIG. 4 and illustrates another embodiment of the thermally actuatable switch construction of this invention.

For example, reference is made to FIG. 5 wherein another thermally actuatable electrical switch construction of this invention is generally indicated by the reference numeral 10B and parts thereof similar to the thermally actuatable electrical switch construction 10 are indicated by like reference numerals followed by the reference letter "B".

As illustrated in FIG. 5, the resilient contact member 23B comprises a separate conductive member 42 that has two legs or parts 26B and 27B joined together at the right hand ends thereof in FIG. 5 by an integral and homogeneous section 28B thereof while the left hand ends thereof are joined together by an integral and homogeneous section 43 thereof that has an opening 44 passing therethrough and is adapted to receive the lead or terminal 21B therethrough so that an enlarged arresting head 45 of the lead or terminal 21B will trap and hold the section 43 of the resilient contact member 23B against the end surface 24B of the end plug 16B as illustrated.

Since it is believed that the natural resilience of the resilient looped contact member 23B will assume the position illustrated in phantom lines in FIG. 5, it can be seen that when the temperature sensitive member 40B is rendered non-solid, the parts 26B and 27B of the contact member 23B tend to spring inwardly out of contact with the internal peripheral surface 34B of the casing 11B to break the electrical connection between the lead 21B and the casing 11B and the cup-shaped guide member 30B is driven to the left in FIG. 5 in the manner previously described to perform its guiding and holding function in the manner previously described.

Figure 6:
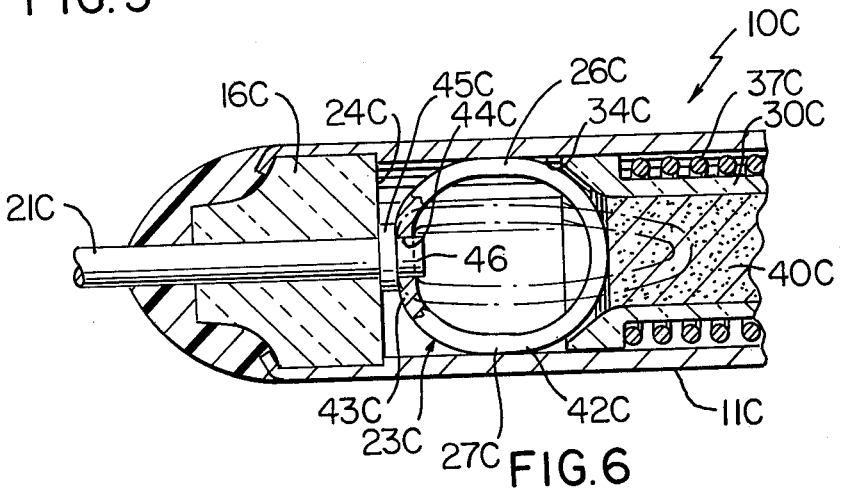
FIG. 6 is a view similar to FIG. 4 and illustrates another embodiment of the thermally actuatable switch construction of this invention.

Another separate resilient contact member 42C is illustrated in FIG. 6 wherein the thermally actuatable electrical switch construction of this invention utilizing the same is generally indicated by the reference numeral 10C and parts thereof similar to the switch constructions 10, 10A and 10B are indicated by like reference numerals followed by the reference letter "C".

As illustrated in FIG. 6, the insulated terminal or lead 21C has the arresting head 45C thereof bearing against the end surface 24C of the end plug 16C and has a projection 46 extending therefrom to the right to be received in an opening 44C through a section 43C of the resilient looped contact member 42C so that the resilient contact member 42C is substantially identical to the resilient contact member 42 of FIG. 5 except that the same is held on the projection 46 of the terminal 21B merely by the force of the compression spring 37C as long as the temperature sensitive member 40C remains solid.

When the temperature sensitive member 40C is rendered non-solid by sensing a predetermined temperature, it is believed that not only will the opposed parts 26C and 27C of the resilient contact means 23C spring inwardly from the internal peripheral surface 34C of the casing 11C for the reasons previously set forth, but also the cup-shaped guide member 30C will be driven to the left in FIG. 6 by the compression spring 37C to completely surround the resilient contact means 23C even if the same should come loose from the terminal 21C so as to be completely trapped within the cup-shaped member 30C.

Therefore, it can be seen that the resilient contact means 23C is not permanently fastened to the terminal 21C but is merely carried thereby and remains thereon as long as the temperature sensitive member 40C is in its solid condition.

It is to be understood that while various forms of terminal means 21, 21A, 21B and 21C as well as the resilient contact means 23, 23A, 23B and 23C therefore have been illustrated and described, it is within the scope of this invention to provide other types of insulated leads and resilient contact means therefore.

Figure 7:
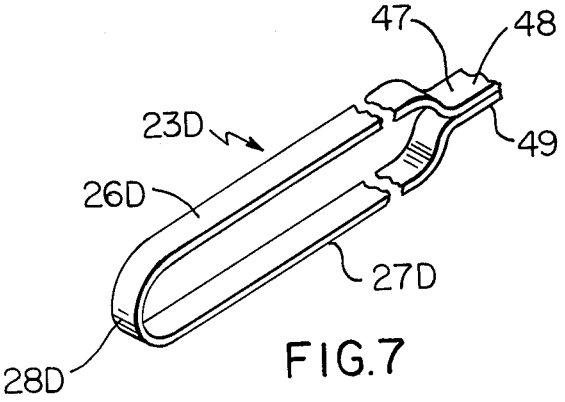
FIG. 7 is a fragmentary perspective view illustrating another embodiment of a resilient contact member of this invention that can be utilized in the thermally actuatable electrical switch construction of this invention.

For example, the resilient contact member and insulated lead could be a conductive ribbon merely looped upon itself as illustrated in FIG. 7.

In particular, FIG. 7 illustrates a conductive ribbon 47 looped upon itself to define a resilient contact means 32D at one end thereof comprising a pair of opposed parts 26D and 27D joined together at the free ends thereof by the integral and homogeneous section 28D whereas the other ends of the parts 26D and 27D come together to define two sections 48 and 49 superimposed upon each other to form the part of the member 47 that would be received within the insulating end plug 16 as previously described and form the terminal or lead 21 extending outwardly therefrom.

Figure 8:
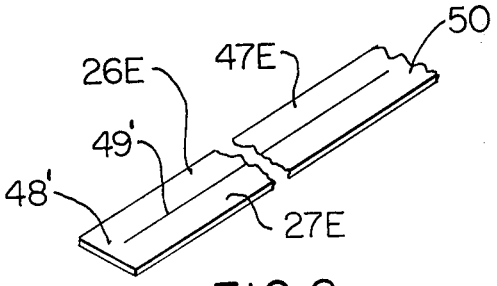
FIG. 8 is a view similar to FIG. 7 and illustrates another embodiment of the resilient contact member of this invention that can be utilized in the thermally actuatable switch construction of this invention.

As illustrated in FIG. 8, the insulated terminal and resilient contact member therefor could take the shape of a single flat ribbon member 47E without having any part looped upon itself and merely have its free end 48' split by a slit 49' to define two side-by-side sections 26E and 27E which could then be placed in opposite directions so that the part 26E would be moved upwardly and the part 27E would be moved downwardly when a force is imposed against the free end 48' of the ribbon 47E in a direction toward the other end 50 thereof, whereby the parts 26E and 27E would define the resilient contact means 23E for the purpose previously described.

While in all the embodiments of the thermally actuatable electrical switch constructions of this invention wherein the same have the ends 41, 41A, 41B and 41C of the pellet 40, 40A, 40B and 40C bearing directly against the resilient contact means 23, 23A, 23B and 23C, it is to be understood that a conventional force spreader, such as a non-conductive disc or the like, can be disposed between the ends 28, 28A, 28B and 28C of the contact means 23, 23A, 23B and 23C and the surfaces 41, 41A, 41B and 41C of the temperature sensitive members 40, 40A, 40B and 40C so as to spread the force of the spring actions therebetween in the manner similar to the force spreader 38 illustrated in FIGS. 1 and 2 of the aforementioned U.S. Pat. to Senor, U.S. Pat. No. 3,930,215.

Therefore, it can be seen that this invention not only provides an improved thermally actuatable electrical switch construction, but also this invention provides an improved method of making such a switch construction or the like.

While the forms and methods of this invention, now preferred, have been illustrated and described as required by the Patent Statute, it is to be understood that other forms and method steps can be utilized and still fall within the scope of the appended claims.

What is claimed is:

1. In a thermally actuatable electrical switch construction having a resilient contact member normally biased into electrical contact with a stationary contact member while a temperature sensitive member of said construction is in a solid condition and normally springing out of contact with said stationary contact member by the natural bias of said resilient contact member when said temperature sensitive member is rendered non-solid by sensing a temperature above a predetermined temperature, the improvement comprising guide means carried by said construction and being operatively associated with said resilient contact member to provide a guide for said resilient contact member that will substantially insure that said resilient contact member will move and be maintained out of contact with said stationary contact member after said temperature sensitive member has been rendered non-solid.

2. A thermally actuatable electrical switch construction as set forth in claim 1 wherein said guide means is movable in said construction to provide its guiding function only after said temperature sensitive member is rendered non-solid.

3. A thermally actuatable electrical switch construction as set forth in claim 2 wherein said guide means comprises spring means.

4. A thermally actuatable electrical switch construction as set forth in claim 3 wherein said guide means comprises a tubular member that telescopes over said resilient contact member under the force of said spring means when said temperature sensitive member is rendered non-solid.

5. A thermally actuatable electrical switch construction as set forth in claim 4 wherein said tubular member is cup-shaped.

6. A thermally actuatable electrical switch construction as set forth in claim 1 wherein said stationary contact member comprises a conductive casing having an open end and an inside surface, an insulative plug disposed in said open end and closing the same, a conductive terminal member being carried by said plug and projecting into said casing, said resilient contact member being carried by said terminal member inside said casing whereby said resilient contact member is held into contact with said inside surface of said casing while said temperature sensitive member is solid.

7. A thermally actuatable electrical switch construction as set forth in claim 6 wherein said resilient contact member is integral and homogeneous with said terminal member.

8. A thermally actuatable electrical switch construction as set forth in claim 6 wherein said resilient contact member has a plurality of parts thereof that make contact with said inside surface of said casing when said temperature sensitive member is solid.

9. A thermally actuatable electrical switch construction as set forth in claim 8 wherein said parts of said resilient contact member make said contact with said inside surface of said casing on opposite sides thereof.

10. A thermally actuatable electrical switch construction as set forth in claim 6 wherein said guide means comprises a cup-shaped member slideable in said casing and having an open end facing toward said plug, said temperature sensitive member when solid comprising a pellet disposed in said open end of said cup-shaped member and substantially filling said cup-shaped member, a compression spring disposed in said casing and acting against said cup shaped member in a direction toward said plug, said resilient contact member engaging against said guide means when said pellet is solid and thereby being expanded radially outwardly into contact with said inside surface of said casing when said pellet is solid.

11. In a method of making a thermally actuatable electrical switch construction having a resilient contact member normally biased into electrical contact with a stationary contact member while a temperature sensitive member of said construction is in a solid condition and normally springing out of contact with said stationary contact member by the natural bias of said resilient contact member when said temperature sensitive member is rendered non-solid by sensing a temperature above a predetermined temperature, the improvement comprising the step of forming a guide means to be carried by said construction and be operatively associated with said resilient contact member to provide a guide for said resilient contact member that will substantially insure that said resilient contact member will move and be maintained out of contact with said stationary contact member after said temperature sensitive member has been rendered non-solid.

12. A method of making a thermally actuatable electrical switch construction as set forth in claim 11 and including the step of forming said guide means to be movable in said construction to provide its guiding function only after said temperature sensitive member is rendered non-solid.

13. A method of making a thermally actuatable electrical switch construction as set forth in claim 12 and including the step of forming said guide means to comprise a spring means.

14. A method of making a thermally actuatable electrical switch construction as set forth in claim 13 and including the step of forming said guide means to further comprise a tubular member that telescopes over said resilient contact member under the force of said spring means when said temperature sensitive member is rendered non-solid.

15. A method of making a thermally actuatable electrical switch construction as set forth in claim 14 and including the step of forming said tubular member to be cup-shaped.

16. A method of making a thermally actuatable electrical switch construction as set forth in claim 11 and including the steps of forming said stationary contact member to comprise a conductive casing having an open end and an inside surface, disposing an insulative plug in said open end to close the same, disposing a conductive terminal member to be carried by said plug and project into said casing, forming said resilient contact member to be carried by said terminal member inside said casing whereby said resilient contact member is held into contact with said inside surface of said casing while said temperature sensitive member is solid.

17. A method of making a thermally actuatable electrical switch construction as set forth in claim 16 and including the step of forming said resilient contact member to be integral and homogeneous with said terminal member.

18. A method of making a thermally actuatable electrical switch construction as set forth in claim 16 and including the step of forming said resilient contact member to have a plurality of parts thereof that make contact with said inside surface of said casing when said temperature sensitive member is solid.

19. A method of making a thermally actuatable electrical switch construction as set forth in claim 18 and including the step of forming said parts of said resilient contact member to make said contact with said inside surface of said casing on opposite sides thereof.

20. A method of making a thermally actuatable electrical switch construction as set forth in claim 16 and including the steps of forming guide means to comprise a cup-shaped member slideable in said casing and having an open end facing toward said plug, forming said temperature sensitive member when solid to comprise a pellet disposed in said open end of said cup-shaped member and substantially filling said cup-shaped member, disposing a compression spring in said casing and to act against said cup-shaped member in a direction toward said plug, and disposing said resilient contact member to engage against said guide means when said pellet is solid and thereby be expanded radially outwardly into contact with said inside surface of said casing when said pellet is solid.

21. A thermally actuatable electrical switch construction as set forth in claim 7 wherein said resilient contact member has a plurality of parts thereof that make contact with said inside surface of said casing when said temperature sensitive member is solid.

22. A thermally actuatable electrical switch construction as set forth in claim 21 wherein said parts of said resilient contact member make said contact with said inside surface of said casing on opposite sides thereof.

23. A method of making a thermally actuatable electrical switch construction as set forth in claim 17 and including the step of forming said resilient contact member to have a plurality of parts thereof that make contact with said inside surface of said casing when said temperature sensitive member is solid.

24. A method of making a thermally actuatable electrical switch construction as set forth in claim 23 and including the step of forming said parts of said resilient contact member to make said contact with said inside surface of said casing on opposite sides thereof.

* * * * *